US005465641A

United States Patent [19]

Herd

[11] Patent Number: 5,465,641

[45] Date of Patent: Nov. 14, 1995

[54] CYLINDER FOR PROCESSING

[75] Inventor: Josef Herd, Munster, Germany

[73] Assignee: Maschinenfabrik Goebel GmbH, Germany

[21] Appl. No.: 122,541

[22] PCT Filed: Mar. 25, 1993

[86] PCT No.: PCT/DE93/00282

§ 371 Date: Sep. 30, 1993

§ 102(e) Date: Sep. 30, 1993

[87] PCT Pub. No.: WO93/19904

PCT Pub. Date: Oct. 14, 1993

[30] Foreign Application Priority Data

Apr. 3, 1992 [DE] Germany ..... 42 11 187.0

[51] Int. Cl.[6] ..... B26D 1/62

[52] U.S. Cl. ..... 83/698.61; 83/674; 83/677

[58] Field of Search ..... 83/331, 663, 677, 83/698.51, 698.61, 699.51, 699.61, 674

[56] References Cited

U.S. PATENT DOCUMENTS

| | | | |
|---|---|---|---|
| 2,341,503 | 2/1944 | La Bombard | 83/323 |
| 3,251,256 | 5/1966 | McGrath | 83/698.61 X |
| 4,594,928 | 6/1986 | Thomas et al. | 83/698.41 |
| 5,282,409 | 2/1994 | Rojas | 83/698.51 X |
| 5,367,936 | 11/1994 | Held et al. | 83/698.61 |

FOREIGN PATENT DOCUMENTS

| | | |
|---|---|---|
| 1264237 | 3/1968 | Germany . |
| 2446722 | 4/1976 | Germany . |
| 878556 | 10/1961 | United Kingdom . |
| 2159089 | 11/1985 | United Kingdom . |

*Primary Examiner*—Rinaldi I. Rada
*Assistant Examiner*—Raymond D. Woods
*Attorney, Agent, or Firm*—Watson, Cole, Grindle & Watson

[57] ABSTRACT

A knife cylinder for processing a continuous web has a plurality of knife blades mounted therein each associated with motors on the cylinder for adjusting each knife in a radial direction during rotation of the knife cylinder. A mechanism on the cylinder is provided for actuating each motor to control the radial adjustment of each knife, and a device located outside the knife cylinder is provided for operating the actuating mechanism.

7 Claims, 2 Drawing Sheets

CYLINDER FOR PROCESSING

BACKGROUND OF THE INVENTION

This invention relates to a knife cylinder for cross-cutting or cross-perforating a continuous web such as paper, plastic, metal, foil, fabric or the like. The knife cylinder is formed with at least one open slot for receiving a knife substantially parallel to the axis of rotation of the cylinder and includes pressure points distributed over the length of the knife for attaching the knife within the cylinder.

U.S. Pat. No. 2,341,503 discloses a sheet cutting mechanism in which a web of material travels through a gap formed between a pressure cylinder and a knife cylinder rotatable in a machine frame for cutting the web. The web loops at least in part around one of the two cylinders. Cutting knives are mounted on the knife cylinder, each knife being mounted for adjustably pre-loading the knife in a radial direction at least by relatively small amounts with respect to the knife cylinder. An adjustable wedge is utilized for this purpose together with resilient means such as a block of rubber. The use of rubber as the elastic medium and a wedge mounted on the cylinder has, however, the drawback that rubber can become hard during the service life thus altering its elasticity. And, the wedge can be only crudely adjusted so that the elasticity of the rubber is not totally utilized and the rubber block which presses the knife against the web or the backup cylinder is significantly higher than necessary so that the cutting edge of the knife is unnecessarily strained and quickly wears out. In addition, the wedge can be adjusted only when the cylinder is not rotating, a feature that renders accurate and fine adjustment of the knife more difficult.

In the knife cylinder disclosed in British Patent No. 878556, the knife blade is radially adjustable with the use of a wedge shifted with the aid of a screw. However, the shifting of the wedge to thus adjust the knife blade is possible only if the knife cylinder is idle and not rotating.

Similarly, radial adjustment of the knife blade of a knife cylinder in German Patent No. 1,264,237 is effected with the use of a turnscrew. However, such adjustment is only possible when the knife cylinder is not rotating.

U.S. Pat. No. 4,594,928, commonly owned herewith, discloses a knife cylinder which includes radially disposed pressure medium cylinders which transmit a force for bracing the knives securely within the knife cylinder.

SUMMARY OF THE INVENTION

If is therefore an object of the present invention to improve upon the prior art knife cylinders in such a manner that the radial adjustment of the knives relative to the counterpressure rotatable cylinder is simplified.

In accordance with the invention, the knife blades of the knife cylinder are located in open slots formed in the cylindrical surface portion of the cylinder, and motor means is disposed within each open slot for rotation together with the cylinder for adjusting the knife in a radial direction during rotation of the cylinder. Means is provided on the cylinder for actuating the motor means to control the radial adjustment of the knife, and stationary means is located outside the cylinder for operating the actuating means.

The knives can be radially adjusted together while the knife cylinder is rotating during a web processing operation, without having to interrupt the rotation of the knife cylinder. Thus, the web processing machine in which the knife cylinder is mounted, such as a form printing machine, need not be interrupted. Consequently, such production stoppage which would result from stopping the knife cylinder or the entire machine is avoided. In addition, the elastic springiness of the knife, to which it is subjected upon radial adjustment in particular during the short period of time when the knife becomes effective, i.e., when confronting the traveling web or the counterpressure cylinder, can also be adjusted. At the same time these influences, which start from the web to be processed on the adjustment of the respective knife, can be readily taken into consideration. Furthermore, the springiness of the knife can be adjusted even when the knife cylinder is rotating.

Other features and advantages follow from the following description of embodiments of the invention. These embodiments can be modified in various ways without departing from the scope of the invention as claimed. In this respect, non-essential machines parts that are adequately known to the expert are not shown in the drawings for the sake of greater clarity. But rather the drawings show only those parts that are necessary to explain the invention in detail and its advantages.

BRIEF DESCRIPTION 0F THE INVENTION

DETAILED DESCRIPTION OF THE INVENTION

Figure 1:
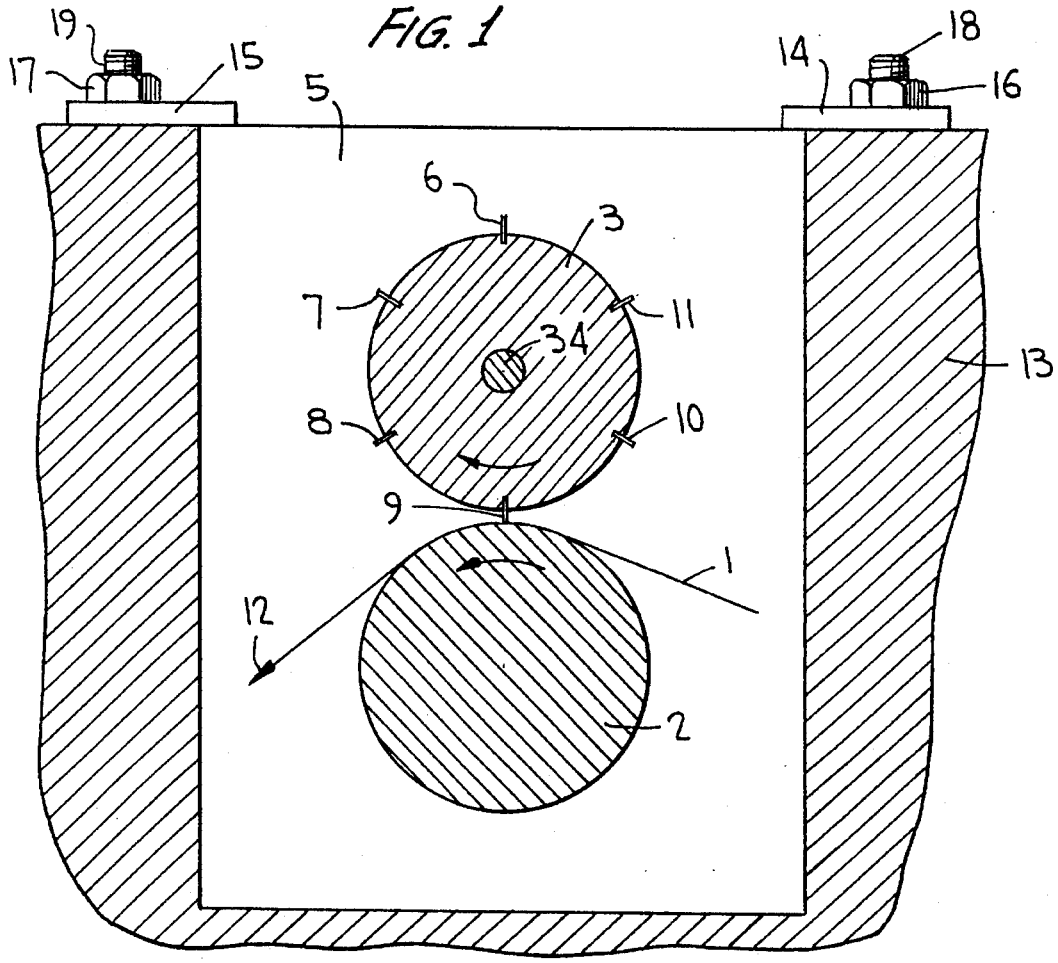
FIG. 1 is a schematic view of the cutting or perforating assembly which includes the knife cylinder of the invention, shown in part as a cross-sectional view.

A web 1 of paper, plastic, metal, film, fabric or the like extends partially about a pressure cylinder 2. Simultaneously web 1 passes through a roller gap, which is formed by pressure cylinder 2 and a knife cylinder 3. Cylinders 2 and 3 can be rotated with the aid of a corresponding bearing 4 in a machine frame 5. At least one of the two cylinders 2 or 3 is driven, but it is also possible that both cylinders be connected together by gear wheels, gear belts or the like so that they can rotate in exact phase relation to each other. Thus, it is only necessary to drive one of the two cylinders, since the other is also driven by the synchronizing device comprising gear wheels, gear belts or the like.

Knife cylinder 3 has knives at knife positions 6, 7, 8, 9, 10 and 11, located within corresponding grooves, open slots, recesses or the like. The knives located at positions 6 to 11 extend substantially in the direction of the geometric axis of knife cylinder 3 and are mounted in the knife cylinder parallel to or slightly sloped relative to this axis. The knives each have a continuous cutting edge or a cutting edge interrupted by transverse grooves. If the knives have a continuous cutting edge, web 1 is transversely cut into single sheets when the web travels through the roller gap formed by cylinders 2 and 3.

If the knife cutting edges are interrupted by transverse grooves, web 1 is not totally severed at right angles to its formation direction. Rather the result is a plurality of spaced cuts in web 1, connected by connecting ties. In this manner web 1 is perforated at right angles to its formation direction indicated by arrow 12. Due to this perforation, it is possible to tear individual sheets from web 1 in a later operation. However, it is also possible, for example, to fanfold the web along the perforation during a later accordian folding operation.

FIG. 1 illustrates one example of a knife cylinder 3, on the circumference of which six cutting knives are distributed uniformally. By contrast, it is also possible to provide the knife cylinder 3 in such a manner that one, two, three, four, five, seven, eight or ten knives or however different number of knives can also be mounted uniformally distributed on the circumference of the knife cylinder. Corresponding to the number and the positions of knives provided, there are also a number of open slots into which the knives are disposed for mounting the knives to the knife cylinder. It is also possible to use only a selected number of such slots for disposing the knives while leaving the remainder containing so-called dummy knives at the non-used positions.

Knife cylinder 3 and pressure cylinder 2 are mounted and can be rotated in such a manner in machine frame 5 that these machine parts form a sub-assembly, which can be removed as a whole from machine frame 13 of the machine and can be exchanged for another similar sub-assembly. Thus, machine frame 5 is mounted in main frame 13 by means of clamping shoes 14 and 15, nuts 16 and 17 and tie rods 18 and 19, threaded into main frame 13, for the period of the machine time. If is also possible to omit machine frame 5 and related fasteners and to position knife cylinder 3 and pressure cylinder 2 directly in main frame 13 of the machine.

Figure 2:
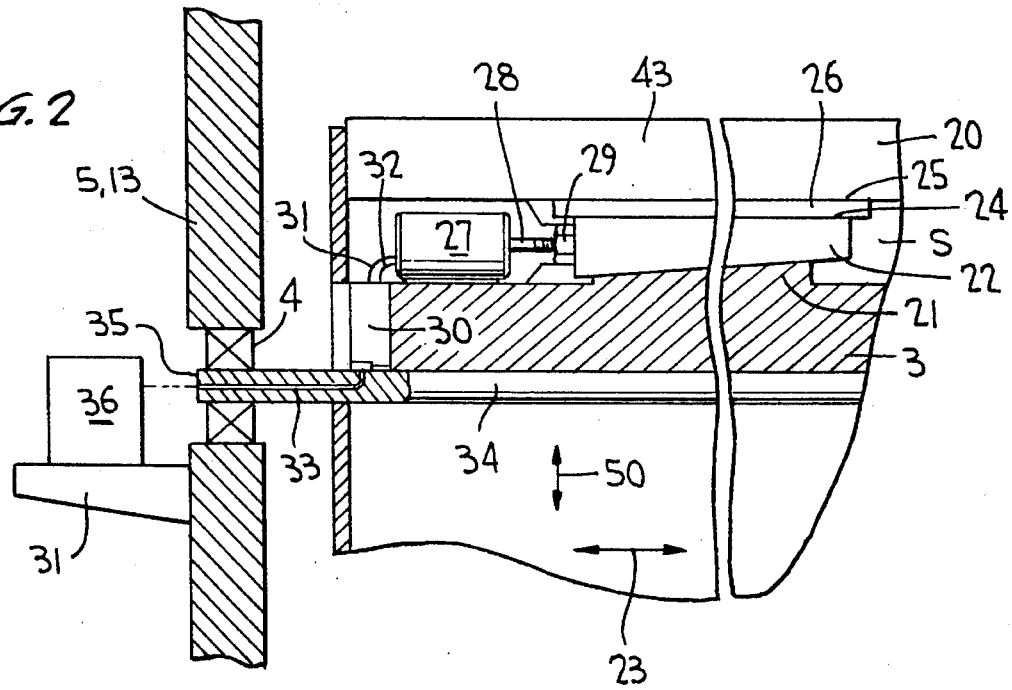
FIG. 2 is a longitudinal sectional view showing part of the knife cylinder of the invention according to one embodiment.

In the FIG. 2 embodiment, at least one web processing tool, such as a knife blade 20, which is radially movable relative to knife cylinder 3, is located within open slot S, and is suitably clamped in place at spaced pressure points 43 therealong. The bottom of the slot has an inclined surface 21 on which a wedge 22 is supported for movement in an axial direction shown by arrow 23, for radially adjusting the knife in the direction of arrow 50.

Outer edge 24 of wedge 22 supports the knife at its inner edge. Optionally, a shim 26 may be disposed between outer edge 24 of the wedge and inner edge 25 of the knife. This shim can be of elastic material such as rubber or any elastic spring. Otherwise, the shim 26 can be omitted.

A motor 27, which may be an electric motor, is mounted within slot S for rotation together with the knife cylinder for moving the wedge in the direction of arrow 23. If the knife cylinder is rotating with the machine running, then wedge 22 can be moved in the desired manner and in the desired amount in the direction of arrow 23 by means of a threaded spindle 28 mounted to the motor output shaft and threaded to an internally threaded nut 29 rotatably mounted on the wedge. Motor 27 may be, for example, in the form of a stepping motor which receives its pulses from a controller 30 and corresponding electrical transmission lines 31, 32. Controller 30 in turn receives corresponding pulses, for example, via a light conducting element 33 which may be in the form of, for example, a glass fiber cable or the like. Preferably, the light conducting element is mounted along the central axis within hollow central axle 34 of knife cylinder 3 which is employed for mounting the knife cylinder in the machine frame with the aid of bearings 4. Element 33 is accessible through terminal end 35 of axle 34 from outside the knife cylinder.

Correspondingly, a light transmitter 36 is fixedly mounted on the machine frame outwardly of the knife cylinder and its central axle 34. Thus, transmitter 36 may be supported on a console 37 which is fixedly mounted on machine frame 5 or main frame 13.

Pulses issuing from light transmitter 36 (using known technology) travel through a light conducting element 33 and to controller 30 which in turn starts the motor which rotates its output shaft 28 in the corresponding amount of rotary steps. The controller may be in form of a so-called infrared controller for the reception of suitable heat pulses from light conducting element 33 as, for example, when transmitter 36 is a type of if transmitter that can transmit infrared rays. Also, controller 30 may be of a type capable of functioning with ultrasonics or may represent a device receiving radio signals or a similar device, if transmitter 36 is a corresponding type transmitter capable of transmitting suitable signals. Thus, it would be not necessary to support transmitter 36 on console 37 mounted on the machine frame. Other possibilities of positioning will suffice so long as the receiver is in a position to receive the pulses issuing from the transmitter so that remote control is possible.

Figure 3:
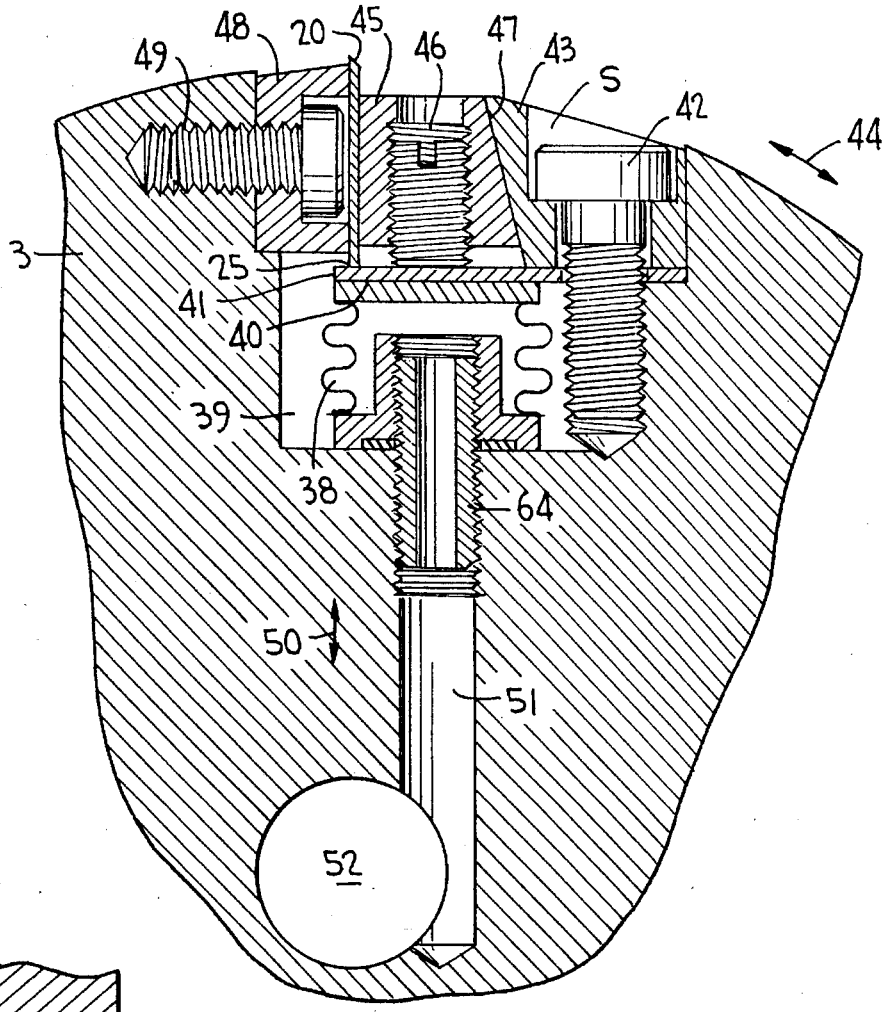
FIG. 3 is a cross-sectional view of part of the knife cylinder of the invention according to another embodiment.

In the FIG. 3 embodiment knife 20 is located within the open slot S formed on the cylindrical surface portion of the knife cylinder in such a manner that it is supported in a radial direction of the knife cylinder by means of at least one pressure medium cylinder 38, which can be a pneumatic or a hydraulic cylinder. Cylinder 38 may also be in the form of a so-called bellows cylinder having a side wall formed of expanded metal anchored to the knife cylinder by a hollow thread element 64.

In the viewing direction of FIG. 3, several such pressure medium cylinders 38 can be arranged in succession in a position for radially supporting the same knife 20. Each pressure medium cylinder is disposed within a common groove, bore, recess, slot S or the like machined into the cylindrical surface portion of the knife cylinder.

A shim 41 may be located between outer surface 40 of pressure medium cylinder 38 and inner edge 25 of knife 20, the shim being formed, for example, of springy steal. In the viewing direction of FIG. 3, several such shims 41 can be arranged in succession, each associated with a pressure medium cylinder 38. However, a single shim 41 may extend over the entire axial extent over the knife cylinder. Shim 41 is attached to the knife cylinder by the provision of at least one screw 42 which can used to attach wedge piece 43 to the knife cylinder. The wedge piece serves to secure knife 20 on the knife cylinder in the direction of arrow 44, i.e., in the circumferential direction of the knife cylinder.

For purposes of attachment, at least one spacer 45 having a sloping face corresponding to the sloping face of the opposing wedge piece 43 and representing a pressure point is provided between knife 20 and the wedge piece. Several such wedge pieces or spacers can be arranged in succession in the viewing direction of FIG. 3. Each spacer also has at least one set screw 46 bearing against shim 41 for setting the radial position of each spacer precisely relative to the knife cylinder, a feature that is usually needed only once during the assembly of the apparatus.

There is a mating sloping surface 47 between wedge piece 43, and spacer 45 which slopes in such a manner that it extends from top left to bottom right as shown in FIG. 3. Thus, during rotation of the knife cylinder, the centrifugal forces during rotation cause the spacer 45 to correspondingly slide a small amount in the direction of arrow 50. In such manner knife 20 is more tightly clamped in place in the direction of arrow 44, i.e., in the circumferential direction of knife cylinder 3.

A shim 48 may be disposed between knife 20 and a radial side wall of the slot S, i.e., on the left side of the knife seen in FIG. 3, and may be secured to the knife cylinder by means of at least one screw 49. The confronting surfaces of shim 48 and each spacer 45 can be relatively smooth so that knife 20 can be shifted slightly in the radial direction of the knife cylinder, i.e., in the direction of arrow 50, by relatively small radial forces, generated by pressure medium cylinder (s) 38 . The result is a different adjusted position of knife 20 relative to web 1 and to counterpressure cylinder 2. Thus, in response to a more or less increase in expansion of the pressure medium cylinder(s) knife 20 can be adjusted relative to the counterpressure cylinder. During this radial adjustment of the knife the thickness and the material of web 1 can be taken into consideration. If, therefore, the radial position of knife 20 is adjustable in such manner relative to knife cylinder 3, it is then possible to press knife 20 sufficiently hard against web 1 that the web will be severed or notched in the desired manner. And, it is possible to lightly press the knife against web 1 in such a manner that it does not unnecessarily strike hard against web 1 or even against counterpressure cylinder 2, while knife cylinder 3 is rotating, so as to avoid any premature dulling of the knife.

Figure 4:
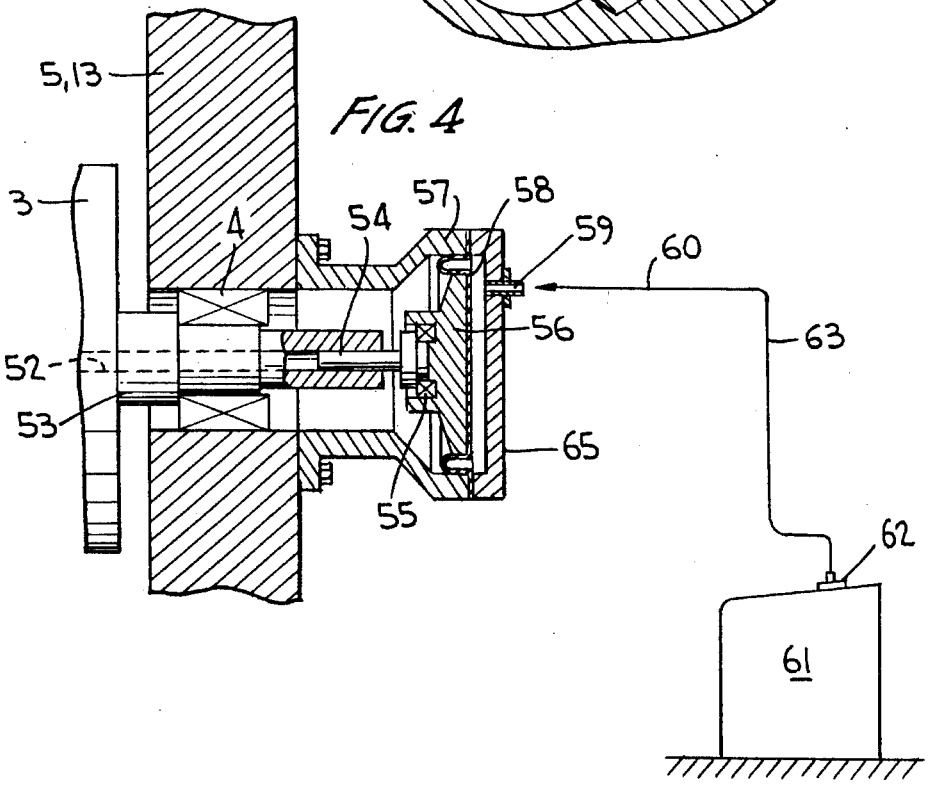
FIG. 4 is a longitudinal sectional view showing a part of the knife cylinder in relation to the machine frame and the means for actuating the motor means of the FIG. 3 embodiment, and showing the stationary means located outside the cylinder for operating the actuating means.

Each pressure medium cylinder 38 receives corresponding pressure medium via a substantially radial channel 51 formed within the knife cylinder in communication with a channel 52 extending substantially coaxial to the knife cylinder. As seen in FIG. 4, channel 52 extends through collar 53 located at one end of the knife cylinder provided for mounting the knife cylinder with the aid of bearing 4 in machine 5 or main frame 13.

A first piston 54 extends in channel 52, piston 54 being mounted at one end for relative rotation in a second piston 56 with the aid of a suitable bearing 55. Thus, piston 56 is stationary and does not rotate together with knife cylinder 3, but is sealed relative to a housing 57 fixed to machine frame 5 or main frame 13. A so-called rolling diaphragm 58 is provided to seal second piston 56 relative to housing 57, the diaphragm being of rubber or similar material. An inlet 59 in an end plate 65 is provided for directing pressure medium in the direction of arrow 60 toward diaphragm 58, i.e., to the right side of piston 56 as shown in FIG. 4. Since piston 56 has a relatively large diameter, and piston 54 a relatively small diameter, the pressure of the medium that flows in the direction of arrow 60 to the first piston 56 is suitably transferred via pistons 56 and 54 to channel 52 and thus to each channel 51 and to each pressure medium cylinder 38. For example, compressed air, which can act as a buffer, can be conveyed in the direction of arrow 60 to piston 56. Channels 51 and 52 as well as a pressure medium cylinder connected thereto can be filled with hydraulic pressure medium.

By the foregoing arrangement knife 20 can be adjusted in a radial direction of the knife cylinder 3 so as to be springy, whereby the springiness can be relatively rigid from the knife cylinder to piston 54. In this section of the pressure system only the elasticity of the outer walls of pressure medium cylinder 38 is effective, in essence. If second piston 56 is braced with the aid of compressed air, which can enter in the direction of arrow 60, as seen, starting from the right side of piston 54 and going to the right in FIG. 4, a relatively elastic and flexible spring characteristic is established which affects the entire medium system. Depending on how high the pressure conveyed in the direction of arrow 60 is, spring characteristic that becomes effective at knife 20 can be adjusted within specific limits. In addition, it is possible to define, preselect or adjust the expansion of the respecting pressure medium cylinder 38 by the amount of compressed air conveyed in the direction of arrow 60, so that the respective knife 20 can be shifted by small amounts in the direction of arrow 50 from outside knife cylinder 3 using a remote control. This results in an adjustment relative to counterpressure cylinder 2.

Housing 57 can comprise a pressure medium feed line which permits the pressure medium to be fed via a machine part that is stationary relative to a rotatable machine part. This results in a transmitter-receiver relationship that permits more or less pressure medium to be conveyed from outside the knife cylinder in more or less desired amounts to the knife cylinder, so that movement of the parts such as knife located on the knife cylinder can be effected even while the knife cylinder is rotating. This applies especially when the amount of pressure medium that becomes effective and the altitude of active pressure can be defined, preselected and adjusted or readjusted, for example, at an operator's panel, likewise from outside knife cylinder 3, i.e., also from outside the machine in which the knife cylinder is installed, and even while the knife cylinder is rotating.

Inclined surface 21, wedge 22 and motor 27 with its threaded spindle 28 and nut 29 of the first embodiment, and all pressure medium cylinders 38 of the second embodiment, represent a motor means on the cylinder within the slot for rotation together with the knife cylinder for adjusting the knife in a radial direction during knife cylinder rotation.

Transmitter 36 of the FIG. 2 embodiment, and inlet 59 as well as adjustable valve 62 located at an operator's panel 61 connected to a pressure generating system (not shown) which can be regulated via a line 63 with the amount and pressure of the pressure medium to be conveyed in the direction of arrow 60, represents a stationary means located outside the knife cylinder for operating the actuating means.

Controller 30 and light conducting element 33 of the FIG. 2 embodiment, and the pressure transfer system of channels 51 and 52 as well as the pressure medium cylinders 38, and the pistons 54 and 56, of the FIGS. 3, 4 embodiment, represent actuating means on the knife cylinder for rotation together therewith for controlling the radial adjustment of the knife.

It may suffice to assign each pressure medium cylinder 38 to a corresponding channel 51 and to connect all channels 51 to a central channel 52. In such manner all the pressure medium cylinders can be jointly adjusted for radially adjusting the circumferentially mounted knives 20 using a single valve 62. Also, it is possible while suitably increasing the cost to control each pressure medium cylinder 38 or each motor 27 individually or in several groups of pressure medium cylinders, motors or the like. In addition, it is possible to permit valve 62 to act on a hydraulically acting pressure medium, whereby the springiness acting in the radial direction of the respective knife cylinder on the respective knife increases in rigidity, thus becoming harder.

Obviously, many other modifications and variations of the present invention are made possible in light of the above teachings. It is therefore to be understood that within the scope of the appended claims the invention may be practiced otherwise than as specifically described.

What is claimed is:

1. A knife cylinder for processing a continuous web, said cylinder being mounted on a frame for rotation about an axis of rotation of said cylinder and comprising:

a cylinder surface portion having at least one open slot formed therein for receiving and positioning at least one knife substantially parallel to said axis of rotation;

means within said slot distributed over the length of said knife for pressing said knife against the knife cylinder;

at least one motor means on said cylinder within said open slot for rotation together therewith for finely adjusting said knife in a radial direction to a predetermined adjusted position during rotation of said cylinder and for retaining said knife in said adjusted position;

said cylinder having a hollow central axle along said axis of rotation;

means operatively connected with said hollow axle for rotation together with said cylinder for actuating said motor means to control the radial adjustment of said knife, and stationary means located outside said cylinder for operating said actuating means.

2. The knife cylinder according to claim 1 wherein said at least one knife comprises a plurality of knives, and said at least one slot comprises a plurality of slots spaced over said cylinder surface portion for respectively receiving and positioning said knives, said motor means being located in each said slot, and said actuating means being operatively coupled with each said motor means for jointly controlling the radial adjustment of each said knife.

3. The knife cylinder according to claim 1, wherein said motor means comprises a motor having a rotatable output shaft and a wedge disposed parallel to said axis of rotation, said output shaft being threadedly coupled to said wedge.

4. The knife cylinder according to claim 3, wherein said motor means further includes a shim located in said slot beneath an inner edge of said knife.

5. The knife cylinder according to claim 3, wherein said at least one motor means comprises a plurality of pressure medium cylinders located in succession within said slot for radially adjusting said knife.

6. The knife cylinder according to claim 3, wherein said actuating means comprises means for pressurizing said cylinder.

7. The knife cylinder according to claim 1, wherein said motor means comprise a bellows cylinder, a shim located between said bellows cylinder and an inner edge of said knife, and a set screw for retaining said knife in said predetermined position.

* * * * *